US005377513A

United States Patent [19]

Miyamoto et al.

[11] Patent Number: 5,377,513

[45] Date of Patent: Jan. 3, 1995

[54] LOCKING DEVICE

[75] Inventors: Kinji Miyamoto, Mie; Imai Akihiko, Tokyo, both of Japan

[73] Assignee: Miwa Lock Kabushiki Kaisha, Tokyo, Japan

[21] Appl. No.: 875

[22] Filed: Jan. 5, 1993

[30] Foreign Application Priority Data

Nov. 27, 1992 [JP] Japan ..... 4-341495

[51] Int. Cl.[6] ..... E05B 47/00

[52] U.S. Cl. ..... 70/276; 70/277

[58] Field of Search ..... 70/276, 277, 279–283, 70/99, 100, 134, 144, 150, 155, 157, 486; 292/163, 164, 172, 142, 144

[56] References Cited

U.S. PATENT DOCUMENTS

| | | | |
|---|---|---|---|
| 478,245 | 7/1892 | Smith | 70/276 |
| 494,146 | 3/1893 | Kintner | 70/276 |
| 698,812 | 4/1902 | Carleton | 70/277 |
| 2,139,183 | 12/1938 | Bruns | 70/277 X |
| 3,284,593 | 11/1966 | Hawkins | 70/276 |
| 3,600,019 | 8/1971 | Toyota | 70/276 X |
| 3,837,193 | 9/1974 | Csurgay | 70/276 |
| 4,649,725 | 3/1987 | Yamashita | 70/276 X |
| 4,656,850 | 4/1987 | Tabata | 70/276 |
| 4,866,961 | 9/1989 | Yang | 70/277 X |
| 4,972,694 | 11/1990 | Aulbers et al. | 70/277 |

FOREIGN PATENT DOCUMENTS

| | | | |
|---|---|---|---|
| 23564 | of 0000 | Germany | 70/277 |
| 4102892 | 8/1992 | Germany | 70/277 |
| 3129074 | 6/1991 | Japan | 70/277 |
| 8902967 | 4/1989 | WIPO | 70/277 |
| 9000659 | 1/1990 | WIPO | 70/277 |

*Primary Examiner*—Peter M. Cuomo
*Assistant Examiner*—Suzanne L. Dino
*Attorney, Agent, or Firm*—Wenderoth, Lind & Ponack

[57] ABSTRACT

To assure that door locking can reliably be achieved, two permanent magnets are arranged for a locking device. One of the permanent magnets, i.e., a first permanent magnet is carried on one end of a trigger member of which central part is turnably supported in a lock box, while the other one, i.e., a second permanent magnet is disposed on a door frame at the position located in alignment with the first permanent magnet when a door is closed. The magnetic pole of the first permanent magnet is coincident with that of the second permanent magnet. When the door is closed, the first permanent magnet is displaced away from the second permanent magnet by the magnetic repulsive force appearing between both the permanent magnets, causing the trigger member to be disengaged from an engagement lever made integral with a control gear, resulting in the dead bolt becoming operatively free. Thus, the dead bolt is displaced in the forward direction by the resilient force of spring means to project outside of a front plate until the foremost end of the dead bolt is inserted into a dead bolt insert hole formed on an opponent door frame. On the contrary, when the door is opened, a knob is actuated to turn the retractor, causing the dead bolt to be retracted to an unlocked position via engagement of the retractor with the dead bolt. Alternatively, the magnetic pole of the first permanent magnet may be coincident with that of the second permanent magnet. In this case, a magnetic attractive force appears between both the permanent magnets.

16 Claims, 5 Drawing Sheets

LOCKING DEVICE

BACKGROUND OF THE INVENTION

1. Field of the Invention

The present invention relates generally to a locking device using permanent magnets. More particularly, the present invention relates to a locking device of the foregoing type which assures that a door can reliably be locked to an opposing door frame once the door is closed.

2. Description of the Related Art

A conventional automatic locking device is generally similar to a latch bolt in that an inclined surface is formed on the head of a so-called dead bolt for locking a door to an opposing door frame, the dead bolt is wedged into a lock box when the inclined surface of the dead bolt contacts a strike member fitted to the door frame as the door is being closed, and when the door is closed, the dead bolt is inserted into a hole in the door frame under the resilient force of a spring.

This device can malfunction when the dead bolt is not forced completely into the lock box by the strike member when the door is incorrectly fitted to the door frame or a closer does not properly operate. In these cases, it is obvious that the door will not be completely locked to the door frame. In the case in which the door is locked using an automatic locking device, a person usually goes outside through the opened door without confirming whether the door automatically locks to the door frame after he leave because he unconsciously believes that the door will be automatically closed. Such a malfunction is unacceptable.

SUMMARY OF THE INVENTION

The present invention has been made in consideration of the foregoing problems in the prior art and as such, it is an object of the present invention to provide a locking device which assures that door will be reliably locked even if the door is incorrectly fitted to an opposing door frame or one does not properly close the door to a certain extent.

More specifically, according to the present invention, there is provided a locking device which comprises a dead bolt normally biased in the forward direction by the resilient force of spring to project outside of a lock box and adapted to be displaced in forward/rearward directions at a right angle relative to a front plate of a lock box; a row of rack gear teeth formed along the lower edge of a dead board of the dead bolt so as to extend in the forward/rearward directions; a control gear rotatably supported at a position located in the vicinity of the dead bolt and meshing with the rack gear teeth; an engagement lever integral with the control gear and extending radially from the control gear; a trigger member having a central part rotatably supported on a side plate of the lock box at a position located in the vicinity of a front plate, one end on which a first permanent magnet is carried, and another end engaged with the engagement lever when the dead bolt is retracted to a position in the lock box where the member assumes an unlocked state, the trigger member being normally biased by the resilient force of a spring in such a direction that the first permanent magnet is displaced toward the front plate; a second permanent magnet disposed in a door frame in alignment with the first permanent magnet when a door is closed, the magnetic pole of the second permanent magnet confronting a magnetic pole of the same polarity of the first permanent magnet so as to cause the latter to be displaced away from the former by the magnetic repulsive force generated thereby; and a narrow elongate retractor in the form of a plate having one end rotatably supported in the lock box and operatively connected to an exterior actuating member such as a knob or the like of the door and another end (front end) engageable with the dead bolt.

In addition, the dead bolt may have a stepped part at substantially the center thereof. In this case, the locking device also includes a locking bar comprising a plate disposed above the dead bolt and extending in the forward/rearward directions in the lock box, the central part of the locking bar being rotatably supported at a position in the vicinity of the dead bolt, and a locking mechanism adapted to be driven to selectively assume one of a locked state and an unlocked state. In the locked state, the foremost end of the locking mechanism is brought into engagement with the stepped part of the dead bolt from the rear of the stepped part. In the unlocked state, the locking bar is away from the stepped part of the dead bolt.

An assembly of the control gear and the engagement lever may include a sector gear.

It is also preferable that the trigger member be substantially L-shaped and have a bent rear for end engagement with the engagement lever.

In practice, the locking mechanism will be an electromagnetic actuator in the form of a solenoid and a locking lever, the locking bar being driven by the solenoid via the locking lever.

In addition, the locking mechanism may include a cylinder lock through which the locking bar is driven via the locking lever.

With such structure, while the door is kept open, the dead bolt is retracted in the lock box to assume an unlocked state even through it is biased by the resilient force of spring in the forward direction toward the outside of the front plate of the lock box. At this time, the resilient force of the spring is transmitted to the engagement lever via the meshing engagement of the rack gear teeth with the control gear. However, since the trigger member is connected to the dead bolt via the control gear and the engagement lever, the dead bolt is held in the unlocked state.

When the door is closed with the dead bolt retracted in the lock box, the first permanent magnet carried on one end of the trigger member is brought into alignment with the second permanent magnet so that the magnetic pole of the first permanent magnet confront that of the second permanent magnet. Accordingly, the first permanent magnet is displaced away from the second permanent magnet, i.e. away from the front plate by the magnetic repulsive force generated by the permanent magnets, causing the trigger member to disengage from the engagement lever. Consequently, the dead bolt is released from the unlocked state, whereby the dead bolt is projected beyond the front plate by the resilient force of the spring until its foremost end is inserted into a dead bolt insert hole in the opposing door frame.

When the door is opened, a knob or the like is actuated to rotate the retractor, causing the dead bolt to be displaced in the rearward direction against the resilient force of the spring. Thus, the foremost end of the dead bolt is displaced away from the dead bolt insert hole and the dead bolt is retracted into the lock box, enabling the door to be opened.

As the dead bolt is displaced in the rearward direction, the control gear meshing with the rack gear teeth and the engagement lever integral with the control gear are rotated in such a direction that the engagement lever is brought into engagement with the trigger member. It should be noted that while the door is kept closed, the trigger member assumes an angular position at which the trigger member is disengaged from the engagement lever due to the magnetic repulsive force.

As the door is opened while the foregoing angular position is maintained, the magnetic repulsive force disappears so that the trigger member can be brought into engagement with the engagement lever to bring the dead bolt to the unlocked position.

It should be noted that the locking mechanism serves to hold the dead bolt at the locked position after the foremost end of the locking bar is brought into engagement with the stepped part of the dead bolt from the rear side.

As an alternative, the trigger member may be normally biased by the spring in such a direction that the first permanent magnet is displaced away from the front plate. In this case, the polarity of the magnetic pole of the second permanent magnet is opposite to the confronting pole of the first permanent magnet so as to cause the latter to be displaced toward the former by a magnetic attractive generated by the magnets.

In this case, the mode of operation of the locking device is the same as that described above with the exception that the locked state is maintained by the magnetic attractive force generated by the permanent magnets which come close to each other when the door is closed.

Other objects, features and advantages of the present invention will become apparent from the following description which has been made in conjunction with the accompanying drawings.

BRIEF DESCRIPTION OF THE DRAWINGS

The present invention is illustrated in the accompanying drawings in which.

DETAILED DESCRIPTION OF THE PREFERRED EMBODIMENTS

The present invention will now be described in detail hereinafter with reference to the accompanying drawings which illustrate preferred embodiments thereof.

First, a first embodiment of a locking device in accordance with the present invention will be described below with reference to FIG. 1 to FIG. 5.

Figure 1:
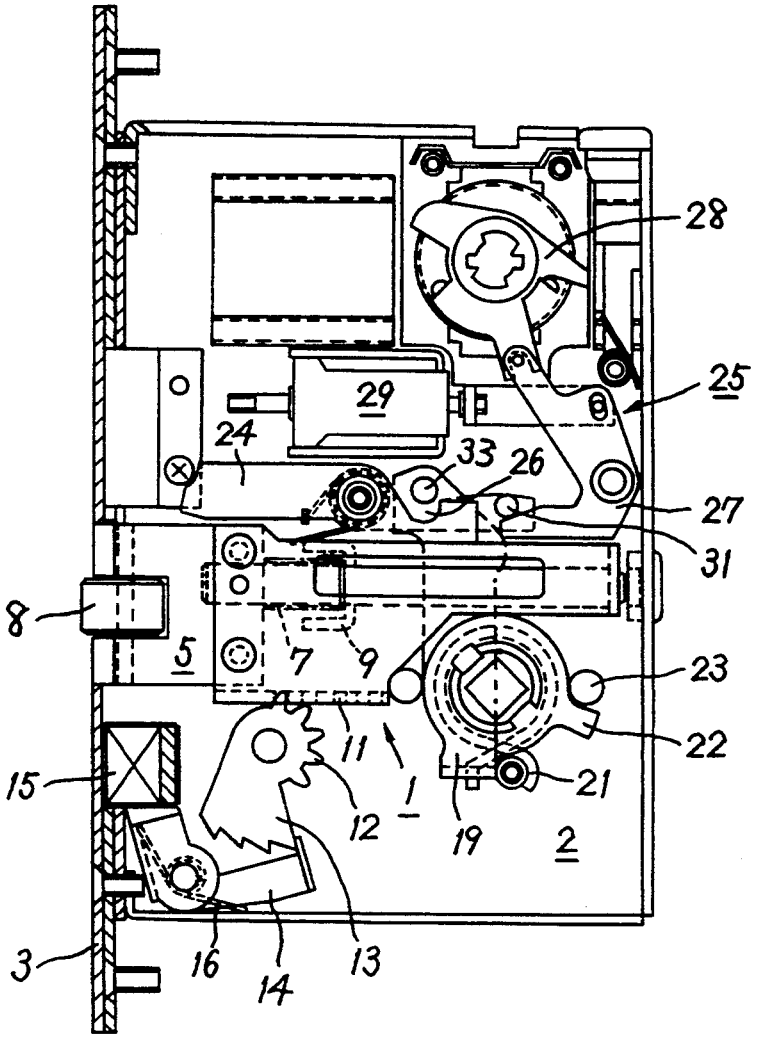
FIG. 1 is a side view, partially in section, of a first embodiment of a locking device in accordance with the present invention, showing the locking device in an unlocked state.

In FIG. 1, reference numeral 1 designates a so-called dead bolt. The dead bolt 1 is mounted in a lock box 2 so as to be displaceable in forward/rearward directions at a right angle relative to a front plate 3 (i.e., in the leftward/rightward directions as seen in FIG. 1).

Figure 2:
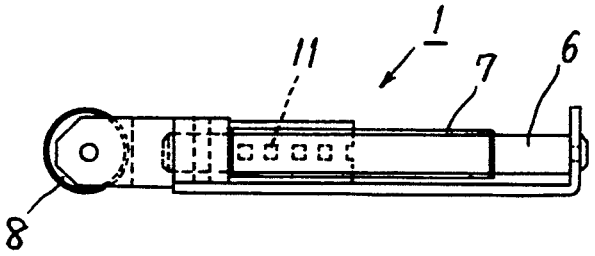
FIG. 2 is a plan view of a dead bolt of the locking device.
Figure 3:
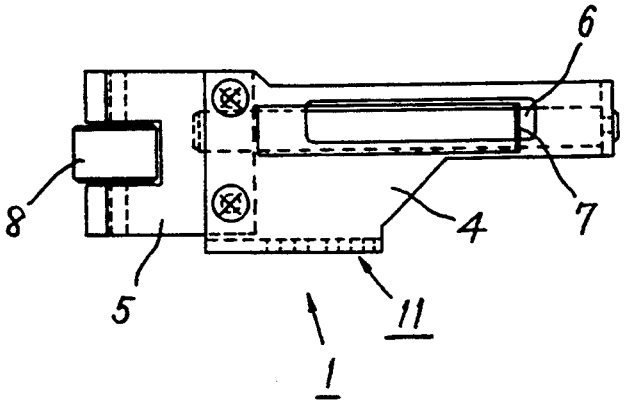
FIG. 3 is a side view of the dead bolt.

As shown in FIG. 2 and FIG. 3, the dead bolt 1 includes a dead block 5 having a rectangular sectional shape and fixedly secured to the front end of a dead board 4 by screws, and a guide rod 6 having a foremost end fitted into a hole formed in the rear end surface of the dead block 5, and a rearmost end fixed to a rear bent part of the dead board 4 by caulking.

A dead spring 7 in the form of a compression coil spring is fitted around the guide rod 6. To assure that the dead bolt 1 is smoothly inserted into a dead bolt insert hole 20 in a door frame to be described later, a dead roller 8 having a vertically extending rotational axis is rotatably supported by the foremost end of the dead block 5.

Referring to FIG. 1 again, the dead bolt 1 is supported in the lock box 2 with the aid of a rectangular hole formed in the front plate 3 and a substantially U-shaped guide piece 9 fixedly secured to a side plate of the lock box 2 and slidably fitted onto the guide rod 6 (see FIG. 1 and FIG. 2) so as to enable the dead bolt 1 to be displaced in the forward/rearward directions. The dead bolt 1 is normally biased in the forward direction (in the leftward direction as seen in FIG. 1) by the dead spring 7 to project beyond the front plate 3.

It is recommendable that the guide rod 6 be fitted to the guide piece 9 by disconnecting the dead block 5 from the dead board 4, fitting the dead spring 7 around the guide rod 6 in the space defined between the guide piece 9 and the dead block 5, connecting the dead block 5 to the dead board 4 and then fixing the guide piece 9 to the side plate of the lock box 2 by caulking.

As is best seen in FIG. 2 and FIG. 3, a row of rack gear teeth 11 in the form of a series of rectangular holes are formed along the lower bent end of the dead board 4 of the dead bolt 1.

As shown in FIG. 1, a control gear 12 is rotatably supported on the side plate of the lock box 2 at a position located in the vicinity of the dead bolt 1. In FIG. 1, the control gear 12 is shown in the form of a sector gear. However, the control gear 12 is not limited to a sector gear. In other words, the designing of the control gear 12 in the form of a sector gear does not constitute any part of the present invention.

An engagement lever 13 is integral with the control gear 12. The engagement lever 13 is designed as a part of a ratchet. Alternatively, the engagement lever 13 may be in the form of an elongate plate which extends in the radial direction of the control gear 12. That is, the engagement lever 13 does not need to be in the form of a part of a ratchet gear as shown in FIG. 1.

In the first embodiment shown in FIG. 1, a trigger member 14 is disposed at the front lower corner of the lock box 2. The trigger member 14 is in the form of a substantially L-shaped lever the central part of which is pivotably supported. A first permanent magnet 15 is attached to the left-hand end of the trigger member 14.

The trigger member 14 is normally biased by the resilient force of a trigger spring 16 in the counterclockwise direction as viewed in FIG. 1, i.e. in such a direction that the first permanent magnet 15 is placed near the front plate 3.

The right-hand end of the trigger member 14 is bent to exhibit an inverted L-shaped contour. In the unlocked state shown in FIG. 1, the trigger member 14 is engaged with the engagement lever 13 at the rear side thereof.

Although the dead bolt 1 is normally biased in the forward direction by the resilient force of the dead spring 7, the control gear 12 meshing with the rack gear teeth 11 of the dead bolt 1 is adapted to rotate in the counterclockwise direction as seen in FIG. 1 to release the dead bolt 1 from the unlocked state. However, since the engagement lever 13 integral with the control gear 12 is engaged with the trigger member 14, the dead bolt 1 is held at the unlocked position shown in FIG. 1.

Figure 4:
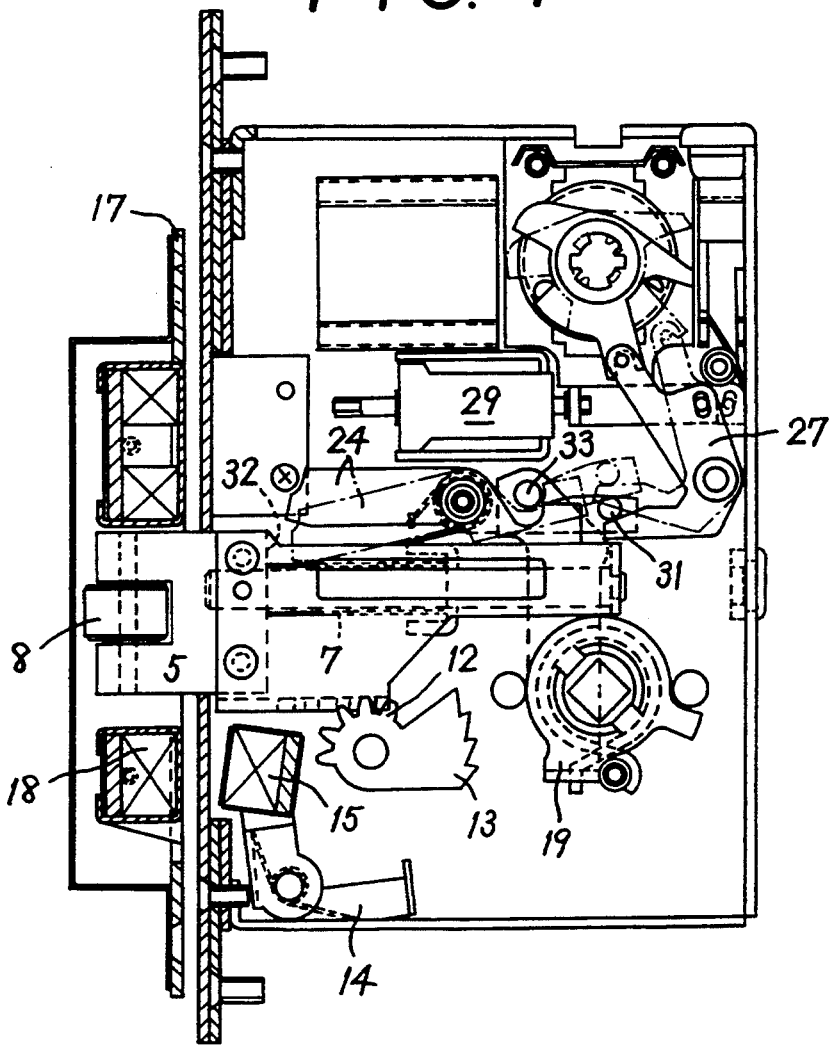
FIG. 4 is a view similar to FIG. 1 but showing the locking device in a locked state.

As shown in FIG. 4, a second permanent magnet 18 is disposed on a strike member 17 provided on the door frame at such a position that the magnetic pole of the first permanent magnet 15 on the front plate 3 confronts the magnet pole having the same polarity of the second permanent magnet 18, i.e. the first permanent magnet 15 is aligned with the second permanent magnet 18, when the door (not shown) is closed.

Once the door is closed, because the first permanent magnet 15 is located opposite to the second permanent magnet 18, the first permanent magnet 15 is repelled inward by the magnetic repulsive force generated by the permanent magnets 15 and 18. Thus, the trigger portion 14 is rotated in the clockwise direction, whereby the engagement lever 13 and the control gear 12 are released from the engaged state, as shown in FIG. 4.

Figure 5:
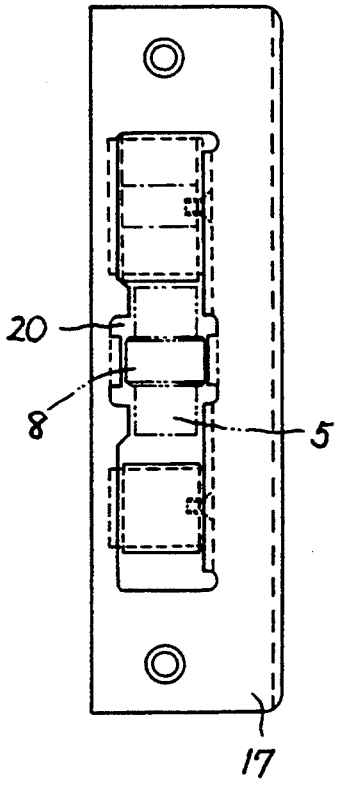
FIG. 5 is a front view of a strike member attached to a door frame.

As a result, the dead bolt 1 becomes operatively free, and the dead block 5 of the dead bolt 1 is then automatically inserted into the dead bolt insert hole 20 in the strike member 17 by the resilient force of the dead spring 7 as shown in FIG. 4 and FIG. 5.

Referred to FIG. 1 again, an elongate plate-shaped retractor 19 having a small width is so disposed in the lock box 2 that it overlaps the rear end part of the dead bolt 1. One end of the retractor 19 (the lower end of the same as seen in FIG. 1) is rotatably supported on the side plate of the lock box 1.

For example, a square hole is formed through the retractor 19 at the central part of the lower end of the same, and an actuation shaft (not shown) :extending through the lock box 2 in the direction of thickness of the door (not shown) is inserted through the square hole. The actuation shaft is operatively connected to an exterior actuating member such as a knob or the like disposed on an inner/outer surface of the door.

The other end of the retractor 19 (free end of the same) projects above the dead bolt 1 by extending between the dead bolt 1 and the side plate of the lock box 2, and is engaged with the rear bent part of the dead bolt 1 (see FIG. 2).

The retractor 19 is normally biased in the counterclockwise direction as seen in FIG. 1 by the resilient force of a retractor spring 21. As long as any exterior force is not exerted on the retractor 19, a radially extending engagement piece 22 of the retractor 19 rests against a stopper 23 on the side plate of the lock box 2 such that the retractor assumes the angular position shown in the drawing.

In practice, the retractor 19 serves to retract the dead bolt 1 from the locked position (see FIG. 4) to the unlocked position (see FIG. 1).

When the door is closed and the dead bolt 1 is inserted into the dead bolt insert hole in the strike member 17 as shown in FIG. 4, the upper end of the retractor 19 is near the rear bent part of the dead bolt 1. Subsequently, when the retractor 19 is rotated in the clockwise direction as seen in FIG. 4 by rotating the knob or the like, the retractor 19 thrusts the rear bent part of the dead bolt 1 with its upper end part, whereby the dead bolt 1 is forcibly retracted into the lock box 2.

At this time, the engagement lever 13 is turned in the clockwise direction via the meshing engagement of the rack gear teeth 11 with the control gear 12, until the angular position of the engagement lever 13 shown in FIG. 1 is restored.

Referring to FIG. 1 again, a narrow elongate plate-shaped locking bar 24 has a central part which is rotatably supported and extends in the forward/rearward directions in the region located in the vicinity of and above the dead bolt 1.

The locking bar 24 serves to fix the dead bolt 1 which has been projected to the locked position. Although the locking bar 24 and a locking mechanism 25 for holding the same are well known to any expert in the art, they will briefly be described below in order to facilitate an understanding of the present invention.

Usually, two plates each having the same shape are integrated by employing, e.g., a spot welding process, to form a fore end part of the locking bar 24 having high rigidity. The rear end part of the locking bar 24 is bent to exhibit a U-shaped sectional shape so that an engagement groove 26 is formed at the thus bent part of the locking bar 24 (see FIG. 1).

In addition, a substantially inverted L-shaped locking lever 27 is disposed in the region behind the locking bar 24 in the lock box 2, and the central part of the locking lever 27 is rotatably supported by the side plate of the lock box 2.

The upper end of the locking lever 27 is operatively connected to a cylinder lock via a so-called rotary assembly 28, and the intermediate part of the same is operatively connected to an output shaft of a solenoid 29 serving as an electromagnetic actuator of an electric lock.

The lower free end of the locking lever 27 is engaged from below with a locking pin 31 at the rear end of the locking bar 24.

When the electromagnetic actuator is activated in response to a locking signal after the door is closed and the dead bolt 1 is then automatically projected to the locking position in the above-described manner, the output shaft of the solenoid 29 is released from the locked state shown in FIG. 4 and moves in the rightward direction, causing the locking lever 27 to be rotated in the clockwise direction. Thus, the lower free end of the locking lever 27 is raised up so that the locking bar 24 is rotated in the counterclockwise direction as illustrated by phantom lines in FIG. 4, whereby the foremost end of the locking bar 24 is brought into engagement with a stepped part 32 of the front end of the dead bolt 1. As long as the foregoing engaged state is maintained, the dead bolt 1 cannot be retracted by any means. In such manner, the locking device has been locked.

As shown in FIG. 4, while the foregoing locked state is maintained, a retractor pin 33 disposed at the upper end of the retractor 19 is received in the engagement groove 26 of the locking bar 24. This is the same when the locking lever 27 is turned in the clockwise direction by the cylinder lock via the rotary assembly 28.

In the first embodiment shown in FIG. 1 to FIG. 5, the locking bar 24 is normally biased in the clockwise direction by the resilient force of a torsion spring, and when the locking lever 27 is turned in the unlocking direction, i.e., in the counterclockwise direction, the locking bar 24 is rotated by the rotational movement of the locking lever 27. Of course, it is obvious that it is not necessary to provide a torsion spring on the locking bar 24, provided that the locking device is modified such that an elongate hole or a long groove is formed at the lower free end of the locking lever 27 and the locking pin 31 is received within the elongate hole or the long groove.

Next, a second embodiment of a locking device in accordance with the present invention will be described below with reference to FIG. 6 to FIG. 10.

The lock device includes a dead bolt 101 as an essential component. In this embodiment, the dead bolt 101 is also mounted in a lock box 102 so as to be displaceable in forward/rearward directions at a right angle relative to a front plate 103 (i.e., in the leftward/rightward directions as seen in FIG. 6).

Figure 7:
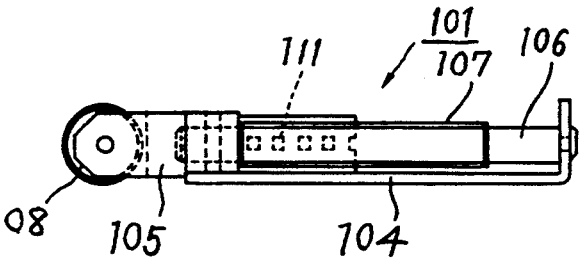
FIG. 7 is a plan view of a dead bolt of the second embodiment of the locking device.
Figure 8:
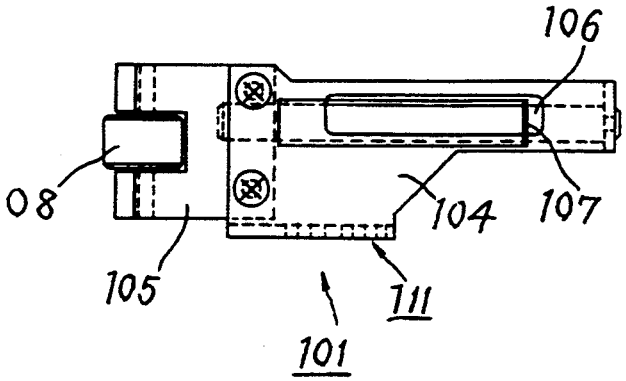
FIG. 8 is a side view of the dead bolt shown in FIG. 7.

As shown in FIG. 7 and FIG. 8, the dead bolt 101 includes a dead block 105 having a rectangular sectional shape and fixedly secured to the front end of a dead board 104 by screws, and a guide rod 106 having a foremost end fitted into a hole formed in the rear end surface of the dead block 105, and a rearmost end fixed to a rear bent part of the dead board 104 by caulking.

A dead spring 107 in the form of a compression coil spring is fitted around the guide rod 106. To assure that the dead bolt 101 is smoothly inserted into a dead bolt insert hole 120 in a door frame to be described later, a dead roller 108 having a vertically extending rotational axis is rotatably supported at the foremost end of the dead block 105.

Figure 6:
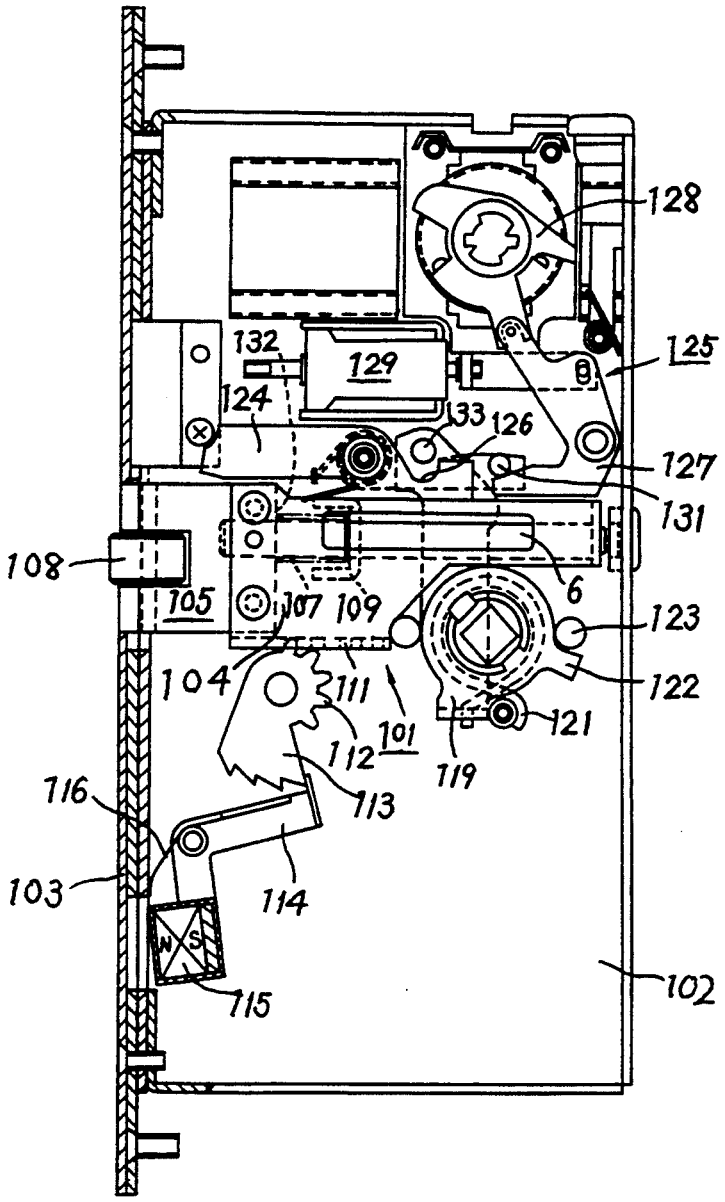
FIG. 6 is a side view, partially in section, of another embodiment of a locking device in accordance with the present invention, showing the locking device in an unlocked state.

Referring to FIG. 6, the dead bolt 101 is supported in the lock box 102 with the aid of a rectangular hole formed in the front plate 103 and a substantially U-shaped guide piece 109 fixedly secured to a side plate of the lock box 102 and slidably fitted onto the guide rod 106 (see FIG. 6 and FIG. 7) so as to enable the dead bolt 101 to be displaced in the forward/rearward directions. The dead bolt 101 is normally biased in the forward direction (in the leftward direction as seen in FIG. 6) by the dead spring 107 to project beyond the front plate 103.

It is recommendable that the guide rod 106 be fitted to the guide piece 109 by disconnecting the guide piece 109 from the dead board 104, fitting the dead spring 107 around the guide rod 106 in the space defined between the guide piece 109 and the dead block 105, connecting the dead block 105 to the dead board 104 and then fixing the guide piece 109 to the side plate of the lock box 102 by caulking.

As is best seen in FIG. 7 and FIG. 8, a row of rack gear teeth 111 in the form of a series of rectangular holes are formed along the lower bent end of the dead board 104 of the dead bolt 101.

As shown in FIG. 6, a control gear 112 is rotatably supported on the side plate of the lock box 102 at a position located in the vicinity of the dead bolt 101. In FIG. 6, the control gear 112 is shown in the form of a sector gear. However, the control gear 112 is not limited to a sector gear. In other words, the designing of the control gear 112 in the form of a sector gear does not constitute any part of the present invention.

An engagement lever 113 is integral with the control gear 112. The engagement lever 113 is designed as a part of a ratchet. Alternatively, the engagement lever 113 may be in the form of an elongate plate which extend in the radial direction of the control gear 112. That is, the engagement lever 113 does not need to be in the form of a ratchet gear as shown in FIG. 6.

In the second embodiment shown in FIG. 6, a trigger member 114 is disposed at the front lower corner of the lock box 102. The trigger member 114 is in the form of a substantially inverted L-shaped lever the central part of which is pivotably supported. A first permanent magnet 115 is attached to the outer end of the trigger member 14.

The trigger member 114 is normally biased by the resilient force of a trigger spring 116 in the counterclockwise direction as viewed in FIG. 6, i.e., in such a direction that the first permanent magnet 115 is located away from the front plate 103.

The right-hand end of the trigger member 114 is bent to exhibit an inverted L-shaped contour. In the unlocked state as shown in FIG. 6, the trigger member 114 is engaged with the engagement lever 113 at the rear side thereof.

Although the dead bolt 101 is normally biased in the forward direction by the resilient force of the dead spring 107, the control gear 112 meshing with the rack gear teeth 111 of the dead bolt 101 is adapted to rotate in the counterclockwise direction as seen in FIG. 6 to release the dead bolt 101 from the unlocked state. However, since the engagement lever 113 integral with the control gear 112 is engaged with the trigger member 114, the dead bolt 101 is held at the unlocked position shown in FIG. 6.

Figure 9:
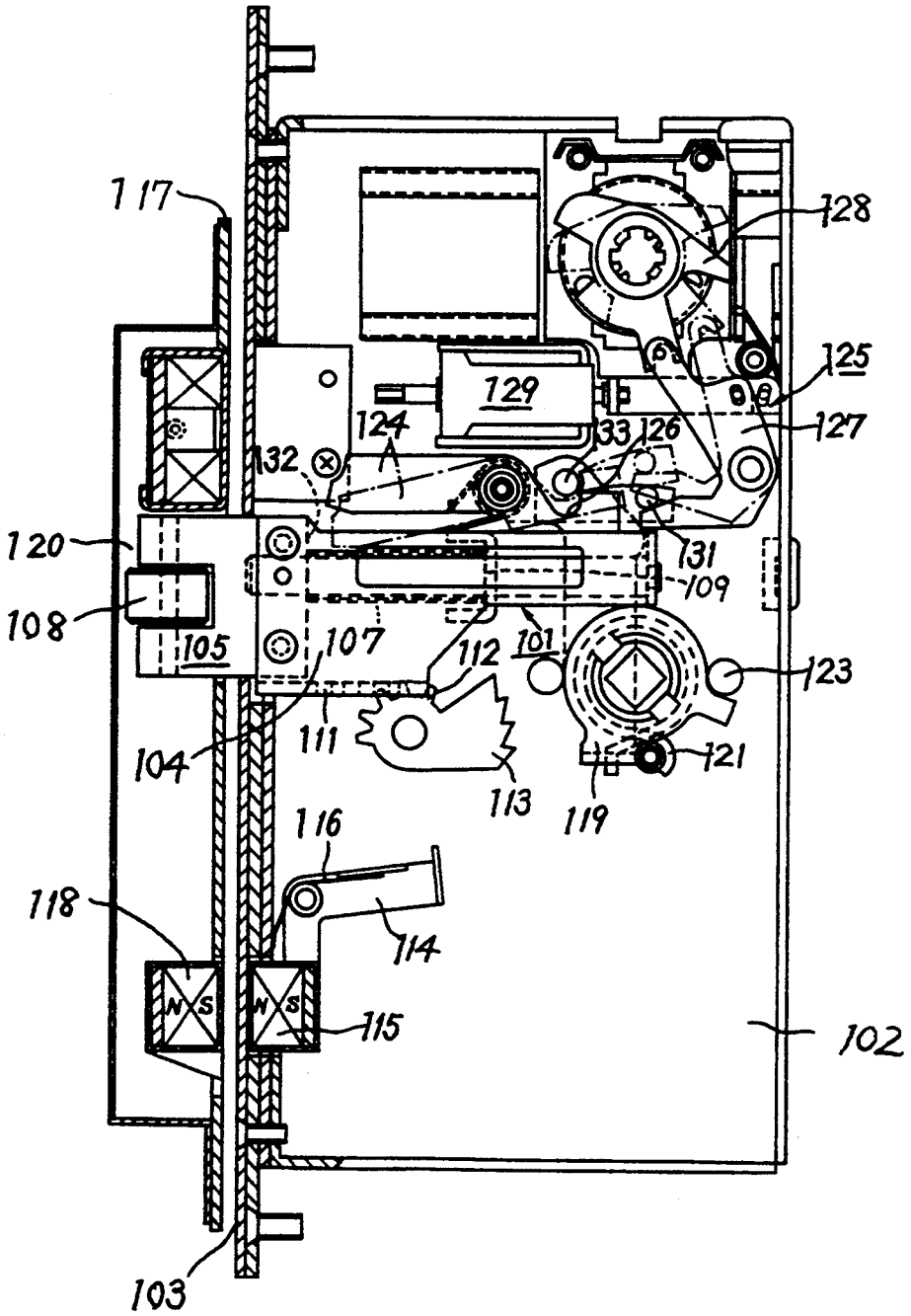
FIG. 9 is a view similar to FIG. 6 but showing the locking device in the locked state.

As shown in FIG. 9, a second permanent magnet 118 is disposed on a strike member 17 provided on the door frame at such a position that a magnetic pole of the first permanent magnet 115 on the front plate 103 side confronts the magnetic pole of the opposite polarity of the second permanent magnet 118 such that the second permanent magnet 118 is attracted to the first permanent magnet 115.

As the door is closed, the first permanent magnet 115 is displaced outside of the front plate 103 toward the second permanent magnet 118 by the magnetic attractive force therebetween, causing the trigger member 114 to be turned in the clockwise direction until the right-hand end of the trigger member 114 is disengaged from the engagement lever 113. Thus, the control gear 112 integral with the engagement lever 113 is released from the engaged state, as shown in FIG. 9.

Figure 10:
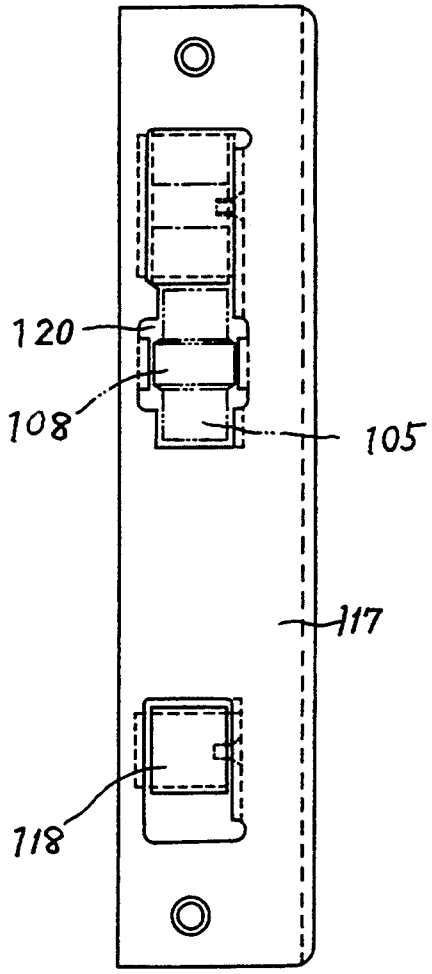
FIG. 10 is a front view of a strike member attached to a door frame.

As a result, the dead bolt 10 becomes operatively free, and the dead block 105 of the dead bolt 101 is then automatically inserted into the dead bolt insert hole 120 in the strike member 117 as shown in FIG. 9 and FIG. 10 by the resilient force of the dead spring 107.

The front plate 103 coming in contact with or located near to the first and second permanent magnets 115 and 118 is made of a non-magnetic material in order to assure that the lines of magnetic force are not interrupted. In addition, it is desirable that members and components located in the vicinity of the first and second permanent magnets 115 and 118 are likewise made of a non-magnetic material in order to avoid undesirable dispersion of the lines of magnetic force.

As shown in FIG. 9, the first permanent magnet 115 has a north magnetic pole opposite the second permanent magnet 118, while the second permanent magnet 118 has a south magnetic pole opposite the first permanent magnet 115. It is obvious that the magnetic poles of both permanent magnets 115 and 118 may be reversed.

Referring to FIG. 6 again, an elongate plate-shaped retractor 119 having a small width is so disposed in the lock box 102 that it overlaps the rear end part of the dead bolt 101. One end of the retractor 119 (lower end of the same as seen in FIG. 6) is rotatably supported on the side plate of the lock box 102.

For example, a square hole is formed through the retractor 119 at the central part of the lower end of the same, and an actuation shaft (not shown) extending through the lock box 102 in the direction of thickness of the door (not shown) is inserted through the square hole. The actuation shaft is operatively connected to an exterior actuating member such as a knob or the like disposed on an inner/outer surface of the door.

The other end of the retractor 119 (free end of the same) projects above the dead bolt 101 by extending between the dead bolt 101 and the side plate of the lock box 102, and is engaged with the rear end part of the dead bolt 101 (see FIG. 7).

The retractor 119 is normally biased in the counterclockwise direction as seen in FIG. 6 by the resilient force of a retractor spring 121. As long as any exterior force is not exerted on the retractor 119, a radially extending engagement piece 122 of the retractor 119 rests against a stopper 123 on the side plate of the lock box 102 such that the retractor 119 assumes the angular position shown in the drawing.

In practice, the retractor 119 serves to retract the dead bolt 101 from the locked position (see FIG. 9) to the unlocked position (see FIG. 6).

When the door is closed and the dead bolt 101 is inserted into the dead bolt insert hole 120 in the strike member 117 as shown in FIG. 9, the upper end part of the retractor 119 is near the rear bent part of the dead bolt 101. Subsequently, when the retractor 119 is rotated in the clockwise direction as seen in FIG. 9 by rotating the knob or the like, the retractor 119 thrusts the rear bent part of the dead bolt 101 with its upper end part, whereby the dead bolt 101 is forcibly retracted into the lock box 102 to the unlocked position.

At this time, the engagement lever 113 is turned in the clockwise direction via the meshing engagement of the rack gear teeth 111 with the control gear 112, until the angular position of the engagement lever 113 shown in FIG. 6 is restored.

Referring to FIG. 6 again, a narrow elongate plate-shaped locking bar 124 has a central part which is rotatably supported and extends in the forward/rearward directions in the region located in the vicinity of and above the dead bolt 101.

The locking bar 124 serves to fix the dead bolt 101 which has been projected to the locked position. The locking bar 124 and a locking mechanism 125 for holding the same are well known to any expert in the art, and have already been described above with reference to FIG. 1 to FIG. 4 in connection with the first embodiment of the present invention. Thus, a description of the locking bar 124 and the locking mechanism 125 will not be repeated.

The above-described locking devices of the present invention have the following advantages.

Firstly, the door will be reliably closed even though it is incorrectly fitted to an opposing door frame or one does not properly close the door to a certain extent.

Secondly, the dead bolt inserted into the dead bolt insert hole can easily be unlocked merely by turning the retractor via an exterior actuating member such as a knob or the like.

Since the dead bolt is inserted into the dead bolt insert hole after the door is completely closed, it is not necessary to form an inclined surface on the dead bolt for creating wedging action between the dead bolt and the strike member at the foremost end of the dead bolt. Thus, a sound is not generated due to a collision of an inclined surface of the dead bolt against the strike member when the door is closed.

In addition, since the dead bolt is not designed with any directionality, the locking device can be actuated with the knob or the like not only from inside of a room but also from the outside of the same.

Additionally, the locked state once obtained when the door is closed can be reliably maintained by the locking bar.

While the present invention has been described above with respect to two preferred embodiments, it should be course be understood that the present invention is not limited to these embodiments but various changes or modifications can be made without departing from the scope of the present invention as defined by the appended claims.

What is claimed is:

1. A locking device for locking a door to an opposing door frame, said locking device comprising:

a lock box in said door, said lock box including a side plate, and a front plate facing the opposing door frame;

a dead bolt supported in the lock box so as to be displaceable in forward/rearward directions at a right angle relative to the front plate of said lock box;

a spring biasing said dead bolt in the forward direction to a position at which the dead bolt normally objects from said lock box through the front plate thereof;

said dead bolt including a dead board, and a row of rack gear teeth extending along a lower portion of the dead board in said forward/rearward directions;

a rotatably supported control gear located in the vicinity of said dead bolt and meshing with said rack gear teeth;

an engagement lever integral with said control gear and extending radially from said control gear;

a trigger member having a central part rotatably supported on the side plate of said lock box at a location in the vicinity of said front plate, one end on which a first permanent magnetic is carried, and another end engaged with said engagement lever when said dead bolt is retracted in said lock box in an unlocked state;

a spring biasing said trigger member in such a direction that said first permanent magnet is placed near said front plate;

a second permanent magnet disposed in the door frame in alignment with said first permanent magnet when the door is closed, said second permanent magnet having a magnetic pole confronting a magnetic pole of the same polarity of said first permanent magnet when the door is closed so as to cause the latter to be displaced away from the former by the magnetic repulsive force generated thereby;

a retractor comprising a narrow elongate plate having one end rotatably supported in said lock box and another end engaged with said dead bolt; and an exterior actuating member located outside of said lock box and operatively connected to said one end of the retractor.

2. The locking device according to claim 1, wherein said control gear is a sector gear.

3. The locking device according to claim 1, wherein said trigger member is substantially L-shaped and has a bent rear end to engage said engagement lever.

4. A locking device for locking a door to an opposing door frame, said locking device comprising:

a lock box in said door, said lock box including a side plate, and a front plate facing the opposing door frame;

a dead bolt supported in the lock box so as to be displaceable in forward/rearward directions at a right angle relative to the front plate of said lock box;

a spring biasing said dead bolt in the forward direction to a position at which the dead bolt normally projects from said lock box through the front plate thereof;

said dead bolt including a dead board, a stepped portion at a central thereof, and a row of rack gear teeth extending along a lower portion of the dead board in said forward/rearward directions;

a rotatably supported control gear located in the vicinity of said dead bolt and meshing with said rack gear teeth;

an engagement lever integral with said control gear and extending radially from said control gear;

a trigger member having a central part rotatably supported on the side plate of said lock box at a location in the vicinity of said front plate, one end on which a first permanent magnetic is carried, and another end engaged with said engagement lever when said dead bolt is retracted in said lock box in an unlocked state;

a spring biasing said trigger member in such a direction that said first permanent magnet is placed near said front plate;

a second permanent magnet disposed in the door frame in alignment with said first permanent magnet when the door is closed, said second permanent magnet having a magnetic pole confronting a magnetic pole of the same polarity of said first permanent magnet when the door is closed so as to cause the latter to be displaced away from the former by the magnetic repulsive force generated thereby;

a retractor comprising a narrow elongate plate having one end rotatably supported in said lock box and another end engaged with said dead bolt;

an exterior actuating member located outside of said lock box and operatively connected to said one end of the retractor;

a locking bar comprising a plate disposed above said dead bolt and extending in the forward/rearward directions in said lock box, said locking bar having a central part rotatable supported at a position located in the vicinity of said dead bolt; and a locking mechanism adapted to be driven to selectively assume one of a locked state and an unlocked state, a foremost end of said locking bar being brought by said locking mechanism into engagement with said stepped portion of said dead bolt from the rear thereof when said locking mechanism is in the locked state, and the foremost end of said locking bar being held away from said stepped portion of said dead bolt by said locking mechanism when said locking mechanism is in said unlocked state.

5. The locking device according to claim 4, wherein said locking mechanism includes a solenoid and a locking lever, and said locking bar is operatively connected to said solenoid via said locking lever.

6. The locking device according to claim 4, wherein said locking mechanism includes a cylinder lock and a locking lever, and said locking bar is operatively connected to said cylinder lock via said locking lever.

7. The locking device according to claim 4, wherein said control gear is a sector gear.

8. The locking device according to claim 4, wherein said trigger member is substantially L-shaped and has a bent rear end to engage said engagement lever.

9. A locking device for locking a door to an opposing door frame, said locking device comprising:

a lock box in said door, said lock box including a side plate, and a front plate facing the opposing door frame;

a dead bolt supported in the lock box so as to be displaceable in forward/rearward directions at a right angle relative to the front plate of said lock box;

a spring biasing said dead bolt in the forward direction to a position at which the dead bolt normally projects from said lock box through the front plate thereof;

said dead bolt including a dead board, and a row of rack gear teeth extending along a lower portion of the dead board in said forward/rearward directions;

a rotatably supported control gear located in the vicinity of said dead bolt and meshing with said rack gear teeth;

an engagement lever integral with said control gear and extending radially from said control gear;

a trigger member having a central part rotatably supported on the side plate of said lock box at a location in the vicinity of said front plate, one end on which a first permanent magnetic is carried, and another end engaged with said engagement lever when said dead bolt is retracted in said lock box in an unlocked state;

a spring biasing said trigger member in such a direction that said first permanent magnet is placed near said front plate;

a second permanent magnet disposed in the door frame in alignment with said first permanent magnet when the door is closed, said second permanent magnet having magnetic pole confronting a magnetic pole of the reverse polarity of said first permanent magnet when the door is closed so as to cause the latter to be displaced toward the former by the magnetic attractive force generated thereby;

a retractor comprising a narrow elongate plate having one end rotatably supported in said lock box and another end engaged with said dead bolt; and an exterior actuating member located outside of said lock box and operatively connected to said one end of the retractor.

10. The locking device according to claim 9, wherein said control gear is a sector gear.

11. The locking device according to claim 9, wherein said trigger member is substantially L-shaped and has a bent rear end to engage said engagement lever.

12. A locking device for locking a door to an opposing door frame, said locking device comprising:

a lock box in said door, said lock box including a side plate, and a front plate facing the opposing door frame;

a dead bolt supported in the lock box so as to be displaceable in forward/rearward directions at a right angle relative to the front plate of said lock box, a spring biasing said dead bolt in the forward direction to a position at which the dead bolt normally projects from said lock box through the front plate thereof;

said dead bolt including a dead board, a stepped portion at a central part thereof and a row of rack gear teeth extending along a lower portion of the dead board in said forward/rearward directions;

a rotatably supported control gear located in the vicinity of said dead bolt and meshing with said rack gear teeth;

an engagement lever integral with said control gear and extending radially from said control gear;

a trigger member having a central part rotatably supported on the side plate of said lock box at a location in the vicinity of said front plate, one end on which a first permanent magnetic is carried, and another end engaged with said engagement lever when said dead bolt is retracted in said lock box in an unlocked state;

a spring biasing said trigger member in such a direction that said first permanent magnet is placed near said front plate;

a second permanent magnet disposed in the door frame at in alignment with said first permanent magnet when the door is closed, said second permanent magnet having magnetic pole confronting a magnetic pole of the reverse polarity of said first permanent magnet when the door is closed so as to cause the latter to be displaced toward the former by the magnetic attractive force generated thereby;

a retractor comprising a narrow elongate plate having one end rotatably supported in said lock box and another end engaged with said dead bolt;

an exterior actuating member located outside of said lock box and operatively connected to said one end of the retractor, a locking bar comprising a plate disposed above said dead bolt and extending in the forward/rearward directions in said lock box, said locking bar having a central part rotatably supported at a position located in the vicinity of said dead bolt; and a locking mechanism adapted to be driven to selectively assume one of a locked state and an unlocked state, a foremost end of said locking bar being brought by said locking mechanism into engagement with said stepped portion of said dead bolt from the rear thereof when said locking mechanism is in the locked state, and the foremost end of said locking bar being held away from said stepped portion of said dead bolt by said locking mechanism when said locking mechanism is in said unlocked state.

13. The locking device according to claim 12, wherein said locking mechanism includes a solenoid and a locking lever, and said locking bar is operatively connected to said solenoid via said locking lever.

14. The locking device according to claim 12, wherein said locking mechanism includes a cylinder lock and a locking lever, and said locking bar is operatively connected to said cylinder lock via said locking lever.

15. The locking device according to claim 12, wherein said locking mechanism includes a solenoid and a locking lever, and said locking bar is operatively connected to said solenoid via said locking lever.

16. The locking device according to claim 12, wherein said locking mechanism includes a cylinder lock and a locking lever, and said locking bar is operatively connected to said cylinder lock via said locking lever.

* * * * *